United States Patent [19]

Harris et al.

[11] Patent Number: 4,920,940

[45] Date of Patent: May 1, 1990

[54] FUEL PUMPING APPARATUS

[75] Inventors: Kenneth M. Harris, Maidstone; George N. Felton; Peter A. G. Collingborn, both of Gillingham; Christopher Stringfellow, Sittingbourne; Godfrey Greeves, Hatch End, all of England

[73] Assignee: Lucas Industries Public Limited Company, Birmingham, England

[21] Appl. No.: 297,413

[22] Filed: Jan. 13, 1989

[30] Foreign Application Priority Data

| | | | |
|---|---|---|---|
| Jan. 16, 1988 | [GB] | United Kingdom | 8800957 |
| Jan. 16, 1988 | [GB] | United Kingdom | 8800955 |
| May 27, 1988 | [GB] | United Kingdom | 8812651 |

[51] Int. Cl.[5] ..... F02M 39/00

[52] U.S. Cl. ..... 123/450; 123/447; 417/462

[58] Field of Search ..... 123/447, 450, 458; 417/462

[56] References Cited

U.S. PATENT DOCUMENTS

| | | | |
|---|---|---|---|
| 4,385,610 | 5/1983 | Leblanc | 123/447 |
| 4,401,082 | 8/1983 | Leblanc | 123/447 |
| 4,445,822 | 5/1984 | Hoshi | 123/450 |
| 4,498,442 | 2/1985 | Tissot | 123/447 |
| 4,550,702 | 11/1985 | Djordjevic | 123/450 |
| 4,601,274 | 7/1986 | Seilly | 417/462 |
| 4,696,271 | 9/1987 | Leblanc | 123/447 |
| 4,725,209 | 2/1988 | Shirata | 123/450 |

FOREIGN PATENT DOCUMENTS

| | | | |
|---|---|---|---|
| 1079923 | 4/1952 | France | 123/450 |
| 1118632 | 6/1956 | France | 123/450 |

*Primary Examiner*—Carl Stuart Miller

*Attorney, Agent, or Firm*—Balogh, Osann, Kramer, Dvorak, Genova & Traub

[57] ABSTRACT

A fuel pumping apparatus of the rotary distributor type includes an accumulator volume into which fuel can be spilled to terminate delivery of fuel by the apparatus. The accumulator is defined by a movable member in the form of a sleeve which is slidable on an extension of the distributor member and has a closed end. The extension defines a seating with which can be engaged by a valve element defined by the sleeve. The extension and sleeve define an annular space connected to the pumping chamber of the apparatus and mechanical means is provided to effect initial movement of the sleeve against the action of a spring to lift the valve element from the seating to allow fuel flow into the accumulator volume.

10 Claims, 4 Drawing Sheets

FUEL PUMPING APPARATUS

Figure 1:
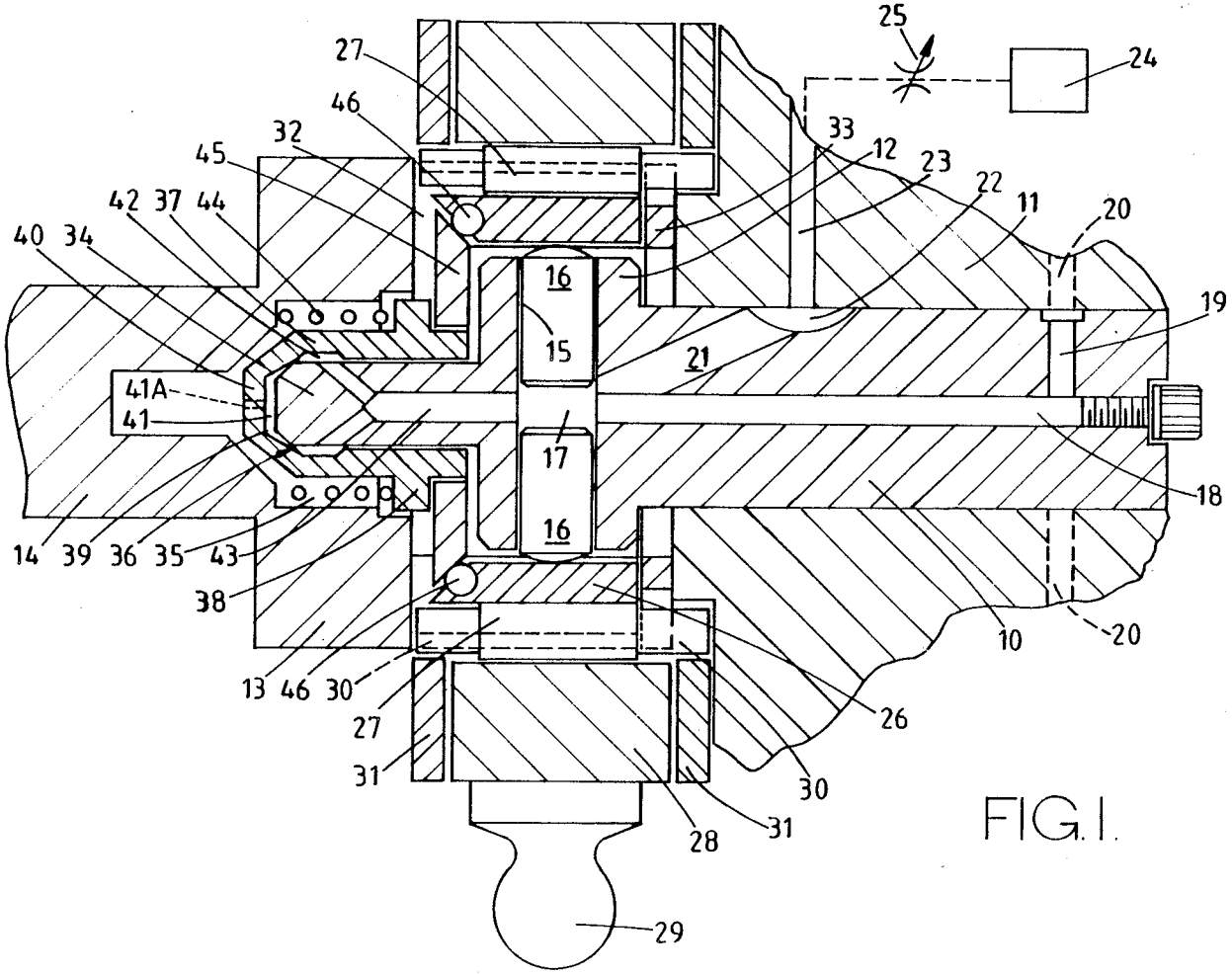

This invention relates to a fuel pumping apparatus for supplying fuel to an internal combustion engine, the apparatus being of the kind comprising a rotary distributor member housed in a body, a drive shaft coupled to the distributor member and arranged in use to be driven in timed relationship with the associated engine, a pumping plunger located in a bore in the distributor member, a plurality of cam lobes housed in the body for imparting inward movement to the plunger as the distributor member rotates, a low pressure pump for supplying fuel to the bore to effect outward movement of the plunger, means for distributing the fuel delivered from the bore during successive inward movements of the plunger to a plurality of outlet ports in turn, and valve means operable during inward movement of the plunger to spill fuel from said bore thereby to terminate delivery of fuel through an outlet.

Such apparatus is known in the art and it has been the practice to allow the fuel spilling from the bore to flow to a cavity within the body of the apparatus. The purpose of spilling the fuel is to cause a rapid reduction of pressure in the outlet receiving fuel, this rapid reduction in pressure allowing a valve in the associated injection nozzle to close quickly. Furthermore, the spillage of fuel is arranged to occur before the cam followers roll over the crests of the cam lobes and in this manner the mechanical stress to which the followers and cam lobes are subjected during the use of the apparatus is reduced.

The fuel which is spilled has to be supplied by the low pressure pump and even if a metering valve is utilized to control the amount of fuel supplied to the associated engine in which case the amount of fuel spilled will be small, as compared with an arrangement where the valve means is used to control the amount of fuel supply to the associated engine, the spilled fuel represents an additional volume of fuel which has to be pumped by the low pressure pump. The low pressure pump must therefore have additional capacity which inevitably means that its physical size must be increased with the attendant increase in cost and the power required to drive the pump.

The object of the present invention is to provide an apparatus of the kind specified in a simple and convenient form.

According to the invention an apparatus of the kind specified includes an accumulator volume into which the fuel spilled through said valve means flows, the spilled fuel being returned to the bore prior to closure of the valve means, at the start of the next filling period of the bore.

According to a further feature of the invention the valve means includes a seating and a valve element and the accumulator includes a movable member, said valve element being defined by said movable member or a part movable therewith, the apparatus including means for imparting initial movement to the movable member.

Figure 2:
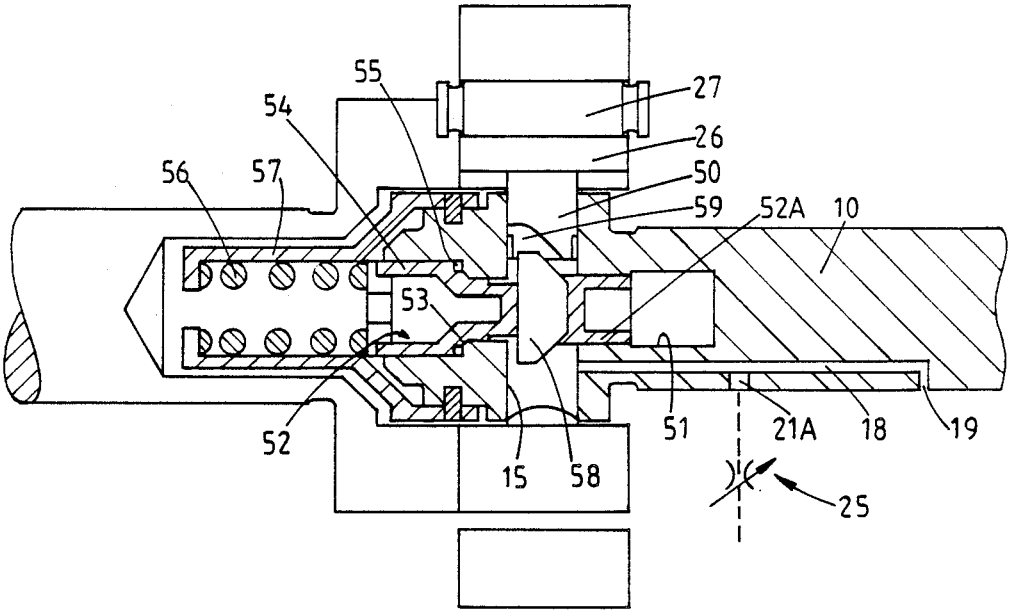
Figure 3:
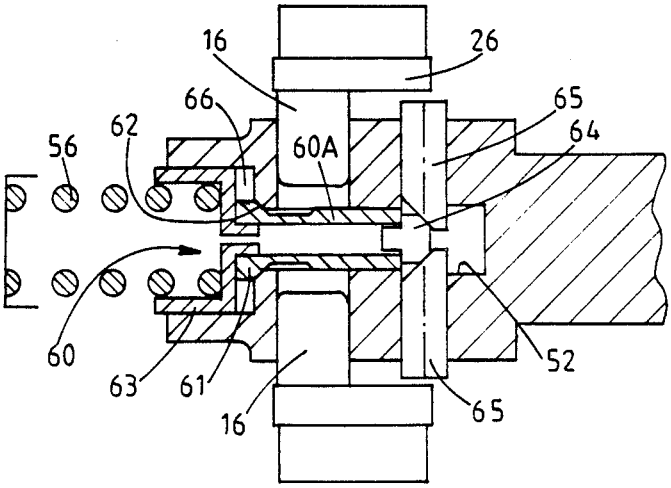
Figure 4:
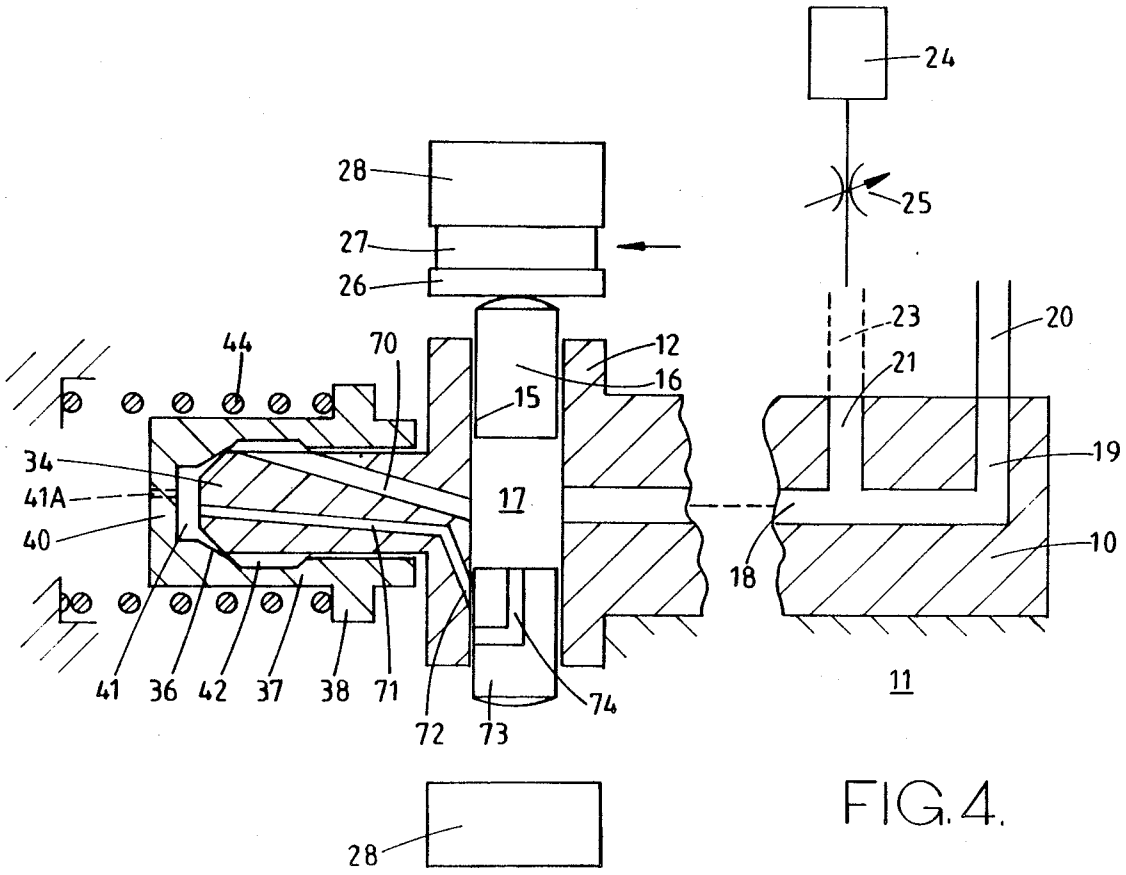
Figure 5:
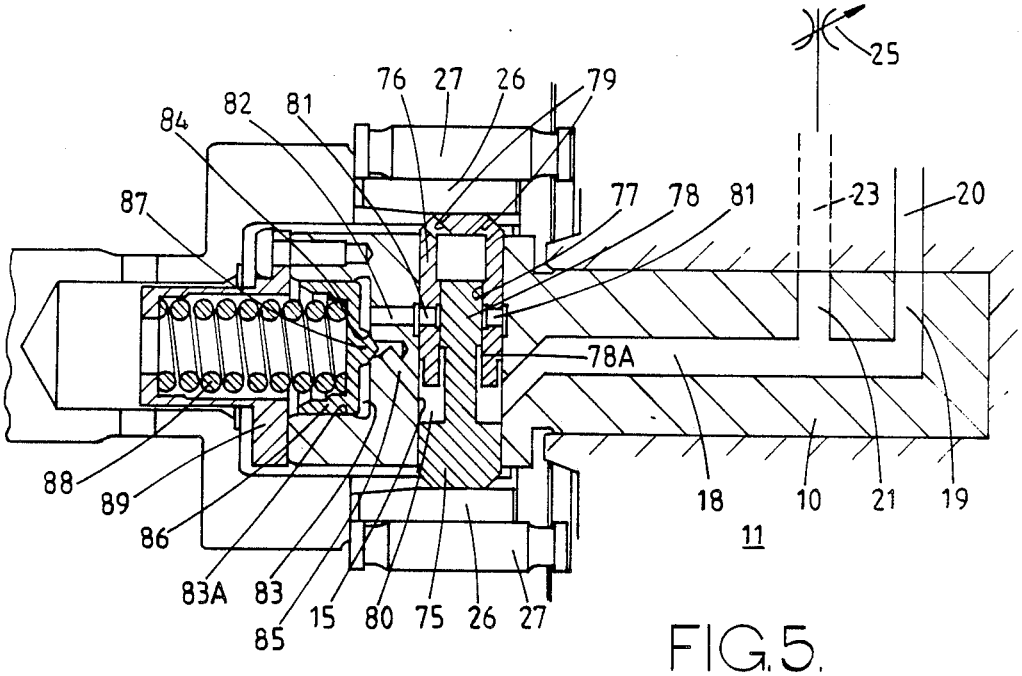
Figure 6:
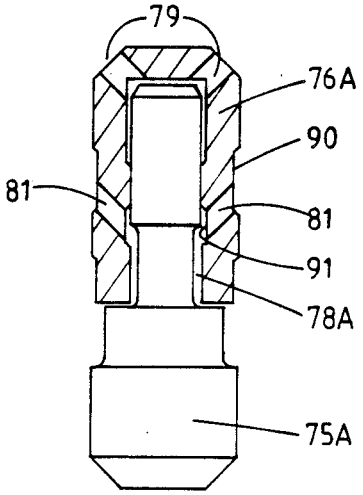

Examples of pumping apparatus in accordance with the invention will now be described with reference to the accompanying drawings in which:

FIG. 1 is a sectional side elevation of one example of an apparatus in accordance with the invention, FIG. 2 shows a modification to the apparatus shown in FIG. 1, FIG. 3 shows a further modification of the example of apparatus seen in FIG. 1, FIG. 4 shows in sectional side elevation another example of an apparatus in accordance with the invention, FIG. 5 shows a modified form of the apparatus shown in FIG. 4, and FIG. 6 shows a modification to part of the apparatus seen in FIG. 5.

Referring to FIG. 1 of the drawings the pumping apparatus comprises a rotary distributor member 10 which is mounted within a body 11. The distributor member is provided with an enlarged portion 12 which is located within a cup-shaped member 13 forming part of a drive shaft 14 which is adapted to be driven in timed relationship with the associated engine. The distributor member is coupled to the drive shaft so as to rotate therewith but is axially fixed within the body 11.

The enlarged portion of the distributor member is provided with a diametrically disposed bore 15 in which is located a pair of pumping plungers 16. The space 17 between the plungers forms the pumping chamber of the apparatus and it communicates with a plugged axially extending drilling 18 in the distributor member and with which communicates a radially disposed delivery passage 19. The passage 19 is positioned to register with outlet ports 20 in turn, the ports in use being connected to the injection nozzles respectively of the associated engine.

Also communicating with the pumping chamber 17 is a passage 21 which terminates in a groove 22 on the periphery of the distributor member, the groove being arranged to register with a plurality of fuel inlet ports 23 only one of which is shown, formed in the body. The inlet ports 23 communicate with the outlet of a low pressure pump 24 the rotary part of which is, in known manner, mounted on the distributor member. A throttle 25 is provided between the outlet of the low pressure pump and the ports 23, to control the amount of fuel which flows to the pumping chamber 17 during the communication of the groove 22 with an inlet port.

At the outer ends of the plungers are located cam followers each of which comprises a shoe 26 which mounts a roller 27. The rollers are positioned to engage with the internal peripheral surface of an annular cam ring 28 which is mounted for angular movement in the body. The cam ring is provided with a peg 29 which is coupled to a piston which is responsive to a pressure which varies with the speed of the associated engine. Conveniently this pressure is the outlet pressure of the low pressure pump 24 which by means of a suitable relief valve does vary with the speed of the associated engine. The rollers are provided with extensions 30 of reduced diameter, the extensions being arranged to engage with the internal peripheral surfaces of a pair of stop rings 31 positioned at the opposite ends respectively of the cam ring. The cam followers are located within slots 32 formed in the skirt portion of the cup-shaped member 13. In this manner the cam followers are driven directly by the drive shaft in known manner. The rollers are located against axial movement by the abutment of the extensions 30 with the base wall of the cup-shaped body and a recessed portion of the body 11 respectively and the shoes are located against axial movement in one direction i.e. towards the right as seen in FIG. 1, by a ring member 33 which rotates with the cup-shaped member.

The distributor member has a cylindrical extension 34 which extends with clearance into a recess 35 in the drive shaft. The end portion of the extension 34 defines a truncated conical seating 36 and axially slidable about the extension 34 is a sleeve-like member 37 having a flange 38 adjacent its end which is adjacent the enlarged portion 12 of the distributor member. The sleeve has an inwardly extending portion 39 which with a base wall 40 and with the end of the extension 34 of the distributor member, defines an accumulator volume 41. The internal surface of the sleeve 37 adjacent the inwardly extending portion 39 is relieved to define an annular space 42 which is permanently connected to the pumping chamber 17 defined by the bore 15, by means of drillings 43 in the extension. In the closed position of the sleeve as shown in FIG. 1, the end walls of the relieved portion 42 are of substantially identical area so that the sleeve is substantially pressure balanced so far as high pressure fuel is concerned. A portion of the internal surface of the sleeve is shaped to form a valve element and the sleeve is biased by means of a coiled compression spring 44, one end of which engages with the flange 38 and the other end of which engages a step defined in the recess 35, so that the valve element engages with the seating 36, the zone of contact being adjacent the outer peripheral surface of the extension 34.

In order to move the sleeve 37 against the action of the spring an annular plate member 45 is provided and this is loosely located about the portion of the sleeve intermediate the flange 38 and the end of the sleeve presented to the enlarged portion of the distributor member. The plate member has extensions which extend into the slots 32 and the outer surfaces of these extensions are obliquely formed and are engageable by rollers 46 carried by the shoes 26 respectively.

Considering now the operation of the apparatus, as shown in FIG. 1, fuel is being supplied to the pumping chamber by way of one of the inlet ports 23 and the groove 22 and passage 21. The amount of fuel supplied depends upon the setting of the throttle 25 but the maximum amount of fuel which can be supplied is determined by the abutment of the extensions 30 of the rollers with the stop plates 31. As the distributor member rotates, the groove 22 is moved out of register with a port 23 and the passage 19 is brought into register with an outlet 20. As soon as this communication has been established the plungers 16 can be moved inwardly by cam lobes on the internal peripheral surface of the cam ring 28, the instant at which inward movement occurs depending upon the amount of fuel supplied to the pumping chamber. As the plungers are moved inwardly, fuel is expelled from the pumping chamber and is delivered to an injection nozzle of the associated engine.

As the shoes move inwardly the rollers 46 contact the oblique surfaces on the plate member 45 which therefore starts to move towards the left as seen in the drawing until the clearance between the plate member and the flange 38 has been taken up. Further inward movement of the cam followers will then cause axial movement of the sleeve 37 resulting in the lifting of the valve element portion of the sleeve from the seating 36. As soon as this movement takes place fuel spills through the passage 43 into the accumulator chamber 41. This causes a rapid reduction in the pressure of fuel in the pumping chamber 17 and this allows the valve in the injection nozzle which is receiving fuel to close quickly to terminate flow of fuel to the engine. As the plungers continue their inward movement, fuel flows into the accumulator volume 41 causing the sleeve to move further against the action of the spring 35.

With continued rotation of the distributor member the passage 19 moves out of register with the port 20 and the groove 22 moves into register with another inlet port 23. Moreover, the rollers will move over the crests of the cam lobes thereby allowing the plungers to move outwardly and the spring 44 urges the sleeve member towards the right and in so doing the previously spilled fuel contained in the accumulator volume 41 is returned by way of the drillings 43 to the pumping chamber 17. The valve element reseats upon the seating 36, the final movement of the sleeve being facilitated by a small orifice 41A which is formed in the portion 40 and which allows the final volume of fuel contained in the accumulator volume 41 to flow to a cavity defined in the apparatus.

With the arrangement described therefore the termination of fuel flow to the associated engine occurs quickly and before the rollers 27 move over the crests of the cam lobes. Moreover, the volume of fuel which is spilt is retained in the accumulator volume and substantially all the spilled fuel is returned to the pumping chamber 17.

A modification is seen in FIG. 2 in which identical reference numerals to those used in FIG. 1 are used for identical components. In the arrangement of FIG. 2 the bore 15 communicates with the passage 18 in the distributor member and the passage 18 communicates with the passage 19. As opposed to the example of FIG. 1, the supply of fuel to the bore 15 is taken through part of the passage 18 by way of an inlet port 21A which communicates with the outlet of the low pressure pump by way of the throttle 25. The plungers 50, only one of which is shown, are of a modified form to those shown in FIG. 1 but they are moved inwardly by cam followers which include rollers 27 supported on shoes 26.

The spillage of fuel from the bore 15 is controlled by a member 52 which is accommodated within a stepped bore 51 which extends axially within the distributor member and traverses the bore 15. Within the narrower portion of the bore 51 there is slidable a portion 52A of the member 52 and this defines a truncated valve element for engagement with a truncated seating 53 defined about the bore. The member 52 also includes an enlarged portion 54 which is slidable in the larger portion of the bore 51 and it defines downstream of the seating 53 an accumulator volume 55. The valve member is biased by means of a spring 56 which is located between the valve member and inwardly directed flange of a stirrup 57 which is secured to the distributor member.

The portion of the member 52 which lies within the bore 15 is provided with a transverse opening in which is a slidable push piece 58 the ends of which locate within slots 59 formed in the inner ends of the plungers 50 respectively. The ends of the push piece 58 and the base walls of the slots have inclined surfaces whereby during the inward movement of the plungers when the aforesaid inclined surfaces engage with each other, further inward movement of the plungers will result in axial movement of the member 52 against the action of the spring 56.

In use during the initial inward movement of the plungers fuel supplied to the bore 15 by way of the throttle, will be displaced along the passage 18 to an outlet and from the outlet to the associated engine. When the inclined surfaces of the plungers engage the ends of the push piece 58, axial movement will be imparted to the member 52 to lift the member from the seating 53 and when this occurs the fuel in the pumping chamber will flow into the accumulator volume 55 such flow of fuel further displacing the member 52 towards the left as seen in the drawing. When the rollers pass over the crests of the cam lobes the volume of fuel in the accumulator volume 55 will be returned to the pumping chamber as the member 52 is moved towards the right under the action of the spring 56. The spilled fuel therefore is returned to the bore and is not lost to the interior of the apparatus.

A further modification is seen in FIG. 3 in which the member 60 comprises a tubular portion 60A having a slightly enlarged head 61 which is shaped to co-operate with a seating 62 defined at the junction of the narrower and wider portions of the bore 52. The member 60 includes a cup shaped member 63 which is slidable in the enlarged portion of the bore, the cup-shaped member 63 having a spigot portion located in the tubular portion 60A. The cup-shaped portion 63 serves as an abutment for the spring 56. At its opposite end the member 60 is provided with a push piece 64 which is shaped for engagement by the inner ends of a pair of actuating plungers 65 positioned for engagement after a predetermined inward movement of the plungers 16, by the cam followers 26. When the actuating plungers are moved inwardly by the cam followers axial movement of the member 60 takes place to lift the head 61 from the seating surface 62. Fuel from the bore containing the plungers 16 can then flow into the accumulator volume 66 defined by the enlarged portion of the bore 52 and the cup-shaped member 63. When the plungers are allowed to move outwardly the fuel contained in the accumulator volume 66 is returned to the bore containing the plungers 16. The push piece 64 is a slack fit within the tubular portion 60A to ensure that each actuating plunger contributes equally to the movement of the member 60.

The examples described illustrate mechanical actuation of the valve means.

Referring now to FIG. 4 there is illustrated an apparatus in which the initial movement of the aforesaid member is effected hydraulically.

The basic construction of the apparatus is the same as the apparatus of FIG. 1 and the same reference numerals are therefore used for the corresponding parts. In the example of FIG. 4 the annular space 42 communicates by way of a passage 70 with the pumping chamber 17 and the portion of the accumulator volume 41 which is defined in the closed position of the member 37, between the base wall 40 of the member 39 and the extension 34 communicates by way of a passage 71 with a port 72 formed in the wall of the bore 15. The port 72 is covered by one of the plungers during delivery of fuel but is connected with the pumping chamber 17 when it is desired to terminate delivery of fuel at a predetermined point before the end of the inward stroke of the plungers. The one plunger 73 is provided with a passage 74 which extends from the inner end of the plunger and terminates on the side wall of the plunger at a position to communicate with the port 72 at a predetermined position of the plunger during its inward movement by the cam. The plunger 73 must be retained against angular movement or it can be provided with a circumferential groove connected to the passage 74.

In use, when the plungers are moved inwardly by the action of the cam lobes fuel will be displaced to an outlet until the passage 74 is brought into communication with the port 72. When such communication is established fuel under pressure is supplied to the volume 41 and in spite of the restricted orifice 41A, the increase of fuel pressure within the volume is sufficient to cause movement of the member 37 thereby lifting the valve element from the seating 36 to allow flow of fuel from the space 42 into the volume. The fuel pressure within the pumping chamber 17 is therefore quickly reduced. After the inward movement of the plungers has taken place and they are allowed to move outwardly the fuel contained in the accumulator volume is returned to the pumping chamber 17.

FIGS. 5 and 6 show a modification of the apparatus seen in FIG. 4 and again the same reference numerals are used wherever possible. With reference to FIG. 5 the transverse bore 15 is occupied by a pair of telescopically engaged plungers 75, 76 the plunger 76 defining a blind bore 77 in which is slidable a piston 78 forming part of the plunger 75. The inner end of the bore 77 is vented to the interior of the apparatus by way of passages 79 and the outer ends of the plungers are engaged by cam followers each comprising shoes 26 and rollers 27. The pumping chamber 80 is of annular form being that portion of the bore 15 lying between the plungers and about the piston 78. The pumping chamber communicates with the passage 18.

The piston 78 over a portion adjacent the head of the plunger is relieved to form an annular clearance 78A with the bore 77 and extending into the bore 77 is a pair of ports 81 which are in constant communication with a circumferential groove formed in the wall of the bore 15. The aforesaid groove communicates with a passage 82 which opens into the inner end of a cylinder 83A formed in the extension of the distributor member. Moreover, centrally disposed in the end wall of the cylinder is a port which is surrounded by a seating 84, the port by way of a short passage 85 communicating with the pumping chamber 80.

Slidable in the cylinder 83A is a sleeve member 86 of cup shaped form the base wall of which has a central projection 87 forming a valve element for co-operation with the seating 84. The member 86 is biased by a strong spring 88 interposed between the member and a hollow abutment 89 secured to the distributor member.

In operation, during inward movement of the plungers fuel is delivered from the pumping chamber 80 to the engine by way of the passages 18 and 19 and a port 20. The strength of the spring 88 is such that the valve element formed by the projection 87 is maintained in contact with the seating 84 against the pressure developed in the pumping chamber 80. At a predetermined position during the inward movement of the plungers the annular clearance 78A which communicates with the pumping chamber 80 will be brought into communication with the ports 81 and fuel under pressure will be introduced into the cylinder 83A. The fuel pressure acts upon the whole area of the member 86 and the latter will now move against the action of the spring 88 to lift the valve element from the seating thereby to allow substantially unrestricted flow of fuel into the accumulator volume 83 formed by the member 86 and the cylinder 83A. As with the previous examples when the plungers start their outward movement the spring 88 will return the member 86 to the position shown and the fuel contained in the accumulator volume will be returned to the pumping chamber 80.

FIG. 6 shows a modified construction for the plungers 75A, 76A in which the ports 81 open into a circumferential groove 90 on the periphery of the plunger and a groove 91 formed in the wall of the bore in the plunger 76A. The piston 78 of the plunger 75A is relieved as in the previous example and fuel from the pumping chamber will flow through the ports 81 at a predetermined position during the inward movement of the plungers.

Although in the examples of FIGS. 5 and 6 the valve element constituted by the projection 87 is maintained in contact with the seating 84 during the normal delivery of fuel to the associated engine, the force applied by the spring 88 can be so chosen that in the event of an excessive pressure being developed in the pumping chamber 80 the valve element will be lifted from the seating to allow fuel to escape into the accumulator volume. Such an excessive pressure could be developed if for eXample the outlet orifice of one of the injector nozzles of the engine became blocked. In this case the fuel spilled into the accumulator volume would be returned to the pumping chamber during delivery stroke of the plungers. The engine would therefore continue to function.

The provision of the accumulator into which the fuel is spilled besides providing the advantages stated in the opening of the specification reduces the volume of fuel which has to be delivered by the low pressure pump and it also has the advantage that the pressures in the pipelines connecting the outlets 20 with the injection nozzles of the engine are stabilized. In some instances it is possible to avoid the use of the conventional unloading delivery valves in the outlets.

We claim:

1. A fuel pumping apparatus for supplying fuel to an internal combustion engine, comprising: a body, a rotary distributor member housed in said body, a drive shaft coupled to said distributor member, said drive shaft being driven in timed relationship with an associated engine, a pumping plunger disposed in a bore in said distributor member, a plurality of cam lobes, said cam lobes imparting inward movement to said plunger upon rotation of said distributor member, a low pressure pump, said low pressure pump supplying fuel to said bore to effect outward movement of said plunger, fuel distribution means for delivering fuel from said bore to a plurality of outlet ports, a movable member and said distributor defining an accumulator volume, a seating defined on said distributor member, a spill passage extending from said bore, a seating defined on said distributor member about said spill passage, a valve element formed on said movable member, said valve element cooperating with said seating, and means operable to impart initial movement to said movable member to lift said valve element from said seating to allow fuel to escape from said bore into said accumulator volume, the fuel flowing into said accumulator volume acting on said member to displace said valve element further from said seating, the fuel in said accumulator volume being returned to said bore at the onset of the next bore-filling period.

2. A fuel pumping apparatus for supplying fuel to an internal combustion engine, comprising: a body, a rotary distributor member housed in said body, a drive shaft coupled to said distributor member, said drive shaft being in timed relationship with an associated engine, a pumping plunger disposed in a bore in said distributor member, a plurality of cam lobes, said cam lobes imparting inward movement to said plunger upon rotation of said distributor member, a low pressure pump, said low pressure pump supplying fuel to said bore to effect outward movement of said plunger, fuel distribution means for delivering fuel from said bore to a plurality of outlet ports, a sleeve, a base wall disposed on said sleeve, said sleeve being slidable relative to an extension of said distributor member, said base wall and said extension defining an accumulator volume, said sleeve having a portion which defines a valve member, said extension defining a seating, and a spring biasing said sleeve so that said valve element is engaged with said seating.

3. An apparatus according to claim 2 including a flange on the sleeve, a plate member movable into engagement with said flange, and an actuating roller for engagement with said plate member said actuating roller being engaged by a part operable by said cam lobes.

4. An apparatus according to claim 2 in which said sleeve is slidable within a cylinder formed in the extension, said sleeve having a base wall which forms with the end wall of the cylinder the accumulator volume, said base wall carrying a projection forming the valve element, and a seating defined about a port in the end wall of the cylinder said port communicating with said pumping chamber.

5. An apparatus according to claim 2 including passage means through which fuel can flow into said accumulator volume from said bore to effect initial movement of said sleeve.

6. An apparatus according to claim 5 in which said passage opens into a port defined in the bore said plunger defining a passage which communicates with the bore and which registers with said port at a predetermined position during the inward movement of the plunger.

7. An apparatus according to claim 5 including a pair of telescopically engaged plungers said bore said plungers defining a pumping chamber therebetween and the plungers further defining a valve which allows fuel flow through said passage means at a predetermined relative position of the plungers during their inward movement.

8. An apparatus according to claim 2 in which said sleeve is slidable within a cylinder formed in the extension the sleeve having a reduced portion which traverses the bore, said reduced portion having a transverse opening and a push piece slidable therein, said plunger having a slot in which is located one end of the push piece, the end of the push piece and the base wall of said slot having inclined co-operating surfaces whereby after a predetermined inward movement of the plunger said surfaces will engage to impart movement to said sleeve to permit fuel flow from the bore into the accumulator volume.

9. An apparatus according to claim 2 in which said sleeve is coupled to a part which carries a push piece, the apparatus further including a pair of actuating plungers the inner ends of which are shaped for engagement with said push piece the outer ends of the plungers being actuable by said cam lobes.

10. An apparatus according to claim 4 including passage means through which fuel can flow into said accumulator volume from said bore to effect initial movement of said sleeve.

* * * * *